US005169405A

United States Patent [19]

Hoyt et al.

[11] Patent Number: 5,169,405

[45] Date of Patent: Dec. 8, 1992

[54] MULTI-COLORED DISPERSE DYEABLE FABRIC: POLYESTER AND POLY-METHYL-OLEFIN BLEND

[75] Inventors: Matthew B. Hoyt, Arden; Bobby J. Bailey, Candler; Dean R. Gadoury, Asheville, all of N.C.

[73] Assignee: BASF Corporation, Parsippany, N.J.

[21] Appl. No.: 797,617

[22] Filed: Nov. 25, 1991

[51] Int. Cl.[5] ..... D06P 5/00; D06P 3/82

[52] U.S. Cl. ..... 8/481; 8/478; 8/480; 8/512; 8/513; 8/529; 8/530

[58] Field of Search ..... 8/481, 512, 513, 530, 8/478

[56] References Cited

U.S. PATENT DOCUMENTS

| | | | |
|---|---|---|---|
| 2,957,225 | 10/1960 | Welch et al. | 526/348.2 |
| 3,102,869 | 9/1963 | Coover et al. | 8/552 |
| 3,361,843 | 1/1968 | Miller et al. | 8/539 |
| 3,375,213 | 3/1968 | Pres | 8/584 |
| 3,432,250 | 3/1969 | Miller et al. | 8/474 |
| 3,439,999 | 4/1969 | Miller et al. | 8/480 |
| 3,652,198 | 3/1972 | Farber et al. | 8/480 |

*Primary Examiner*—A. Lionel Clingman

[57] ABSTRACT

A predominantly polyester fabric has a multi-colored pattern. The fabric includes at least one non-aromatic, partially crystalline polymethylolefin yarn melting above about 180° as less than 50%, by weight, of the fabric, and polyester yarn. The polymethylpentene yarn and the polyester yarn are fabricated in a predetermined pattern and then piece dyed with disperse dye techniques.

13 Claims, No Drawings

MULTI-COLORED DISPERSE DYEABLE FABRIC: POLYESTER AND POLY-METHYL-OLEFIN BLEND

FIELD OF THE INVENTION

The present invention relates generally to piece dyeing. More specifically, the present invention relates to differentially dyeable fabrics having, after dyeing, a color pattern.

BACKGROUND OF THE INVENTION

As used herein, the term "precolored" means that a colorant, such as a pigment or dye, is added to a polymer prior to melt extrusion to form fibers. The term "yarn" means a continuous strand of fiber or fibers in a form suitable for knitting, weaving or other interweaving into a textile fiber. The term "piece dye" means dyeing of fabrics in fabric form after weaving or knitting as opposed to dyeing in the yarn.

Fabrics which can be supplied uncolored and which have a pattern after dyeing have advantages over fabrics which are made from package dyed yarns. For example, uncolored fabrics which demonstrate a pattern after piece dyeing are very versatile. These fabrics can be supplied to the user, who selects the color to coordinate with other features of the end product. Where automotive uses are intended, the uncolored fabric may be dyed blue to match a blue interior or red to match a red interior. Whether red or blue, the fabric will have a predetermined pattern. The fabric maker no longer must keep a large selection of yarn dyed materials to fill orders for patterned fabric.

Polyester yarns are known to be readily dyed using disperse dyes in aqueous systems. Typically, fabrics from these polyester yarns are dyed under pressure and at temperatures of 130° C. to 150° C. and then heatset. This method of dyeing polyester fabrics is popular because the polyester fabric readily takes the disperse dyes under the pressure and temperature conditions, producing good, consistent color. However, the method does not readily allow patterns, for example, pin stripes within the fabric, since all of the polyester fiber will take the dye during the dyeing operation.

Polyolefins, on the other hand, are known in the art as difficult if not impossible to dye using disperse dyes in water or water-carrier systems. In general, polyolefins are extremely hydrophobic so that the water and other dye carriers in the dye bath do not penetrate the polyolefin fiber to an extent great enough to produce a good dye color. Modified polyolefins are known. U.S. Pat. No. 2,957,225 to Welch et al. describes a fiber of poly(4-methyl-1-pentene), which is produced under special conditions and polymerized with a special type of catalyst composition composed of particular metal halide salts having certain alkyl groups attached thereto.

It is known that poly(4-methyl-1-pentene) is difficult to dye without modification of the polymer. U.S. Pat. No. 3,102,869 to Coover, Jr., et al. discloses a dyeable poly-alpha-olefin, including polymethylpentene, fiber containing polyvinyl acetal resins to provide dyeability of the normally non-dyeable polyolefin fiber. U.S. Pat. No. 3,375,213 to Press describes a method of modifying polyolefins with synergistic polymeric combinations to allow dyeability under conditions normally used for polyester fabrics.

Due to the relatively high temperatures involved in dyeing and heatsetting of polyester, most polyolefin materials would not survive this processing intact. That is, many polyolefin fibers subjected to these high temperatures would soften, resulting in a loss of molecular orientation and a corresponding loss in strength of the fiber. Softening can also result in a loss of texture or crimp in the fiber, which in turn gives an appearance of less fiber for a given weight of fiber (less bulk). In some cases, polyolefin filaments soften or even melt to the point that filaments within the yarn bundle and even between yarn bundles adhere to one another. This causes a loss of strength and appearance in the fabric. An additional effect on some of the more commonly used polyolefins is that, due to the lower melting points and glass transition temperatures, dyes in the dyebath could more easily penetrate into these fibers. But polymethyl pentene absorbs considerably less dyestuff.

Surprisingly, it has been discovered that certain polymethylolefin fibers can be combined with polyester fibers to make a fabric which can be piece dyed using disperse dyes and dyeing systems to produce a multicolor patterned primarily polyester fabric without detriment to the polymethylolefin. Such a fabric is especially desirable for automotive uses. For automotive uses, upholstery is most often polyester and prevalent dyeing techniques produce solid color fabrics. It is believed that present patterned automotive fabrics are created with package dyed yarns. At least two different colored yarns are made into a fabric having the preselected pattern. A multi-colored fabric produced by dyeing rather than specially weaving two preselected color threads represents a substantial advance in economy and versatility.

SUMMARY OF THE INVENTION

The present invention provides a predominantly polyester fabric having a multi-colored pattern. The fabric has at least one non-aromatic, partially crystalline polymethylolefin yarn melting above about 180° C. yarn as less than 50% by weight of the fabric, and polyester yarn. The polymethylolefin yarn and the polyester yarn are fabricated together in a predetermined pattern and then piece dyed with disperse dye techniques.

It is an object of this invention to provide an improved predominantly polyester fabric.

Related objects and advantages of this invention will be apparent to those ordinarily skilled in the art after examination of the following description:

DETAILED DESCRIPTION OF THE PREFERRED EMBODIMENTS

To promote an understanding of the principles of the present invention, descriptions of specific embodiments of the invention follow and specific language describes the same. It will nevertheless be understood that no limitation of the scope of the invention is thereby intended, and that such alterations and further modifications, and such further applications of the principles of the invention as discussed are contemplated as would normally occur to one ordinarily skilled in the art to which the invention pertains.

The present invention conveniently provides an undyed fabric which is dyeable to any available specified color and yet a predetermined color pattern results. In accordance with this invention, it has been found that a piece dyed predominately polyester fabric having a multi-colored pattern therein may be produced by combining in the fabric at least one precolored (or uncolored) polymethylolefin yarn with polyester yarn. The polymethylolefin yarn is less than 50% by weight of the finished fabric, and is woven or knitted with polyester yarn in a graphic design using a predetermined pattern. The resulting polyester fabric is then dyed in the conventional manner. It will be readily understood that the invention contemplates using an uncolored polymethylolefin yarn to create a contrasting yarn relative to the dyed polyester yarn. A further embodiment of the invention is a method for producing such fabric and the use of such fabric for automotive upholstery.

Polyesters useful in the present invention include, for example, poly(ethylene terephthalate), poly(butylene terephthalate), polytetramethylene terephthalate), poly(1,4-dimethylcyclohexane terephthalate), and copolyesters such as poly(ethylene terephthalate) containing small amounts of 5-(sodiumsulfo)isophthalate or similar compounds. Polymethylolefins useful in the present invention include non-aromatic, partially crystalline polymers which melt above about 180° C. These include poly(4-methyl-1-pentene), poly(3-methyl-1-pentene), poly(3-methyl-1-butene) and poly(4-methyl-1-hexene). Poly(4-methyl-1-pentene) is preferred. Polyester and polymethylpentene yarns are prepared separately according to known processes for spinning polymers of the type. Each material is melt spun and drawn into a multifilament yarn. The drawing of each yarn may be done in a single step with the extrusion or a separate step after extrusion. Additionally, these yarns may be texturized or crimped. The filaments may be cut into staple fibers and then processed through a staple yarn procedure, but the preferred method is to have the filament remain substantially continuous.

The polymethylolefin yarn may have a colorant introduced during extrusion before the polymeric melt passes through the spinnerette. This introduction may be accomplished via several methods. One method involves the use of a side-arm extruder to meter molten colorant in a polymer matrix. A dry additive feeder using either gravimetric or volumetric measurements may also be used. For the latter technology, the colorant, usually diluted in a polymer matrix, is mixed with the polymethylolefin at the throat of the extruder. Other methods of coloring polymers prior to extrusion are known and available for use with the present invention. It is contemplated that more than one polymethylolefin yarn may be used and that each yarn will be colored with a different colorant.

The individual yarns are then combined to form a fabric. Methods of forming such fabrics would include weaving, warp knitting, circular knitting, tufting into a backing material, and felting. After fabrication of the fabrics, they are dyed.

Typical polyester dyeing methods result in very little of the dyestuff entering the polymethylpentene filaments, while the polyester filaments will become deeply colored. This differential dyeing will result in a fabric with contrasting yarns. Depending on the fabric forming process used, and the selection of colorants and level of colorant addition in the polymethylpentene filaments, the fabric may have a wide variety of patterns and images created by the colored filaments.

It is especially preferred to combine the two yarns in a warp knitting process according to known processes. By the introduction of the polymethylpentene yarn as one component of the warp knit, contrasting stripes can be produced. With more complex machinery, graphics patterns could be created. Such fabrics are useful as automotive upholstery, because the present predominant technology for producing piece-dyed automotive fabrics only produces solid, one-color fabrics.

In the following examples, total color difference (Delta E) between dyed and undyed samples is determined using the 1976 C.I.E. (D6500; illuminant, 10 degree observer) L*a*b* system. Details on C.I.E. L*a*b* measurements and calculation of total color difference (Delta E) are found in the color science literature, for example, F. Bellmeyer and M. Saltzman, *Principles of Color Technology*, 2nd Edition.

The invention will be described by reference to the following detailed examples. The Examples are set forth by way of illustration, and are not intended to limit the scope of the invention. For example, specific surfactants and dyestuffs were used but the choice of these materials as part of a dyeing process is not critical to the invention claimed.

EXAMPLE 1

Three 100% polymethylpentene (PMP) yarns separately pigmented white, red and gold are prepared by conventional PMP melt spinning techniques. White yarn is natural, uncolored PMP yarn. Red yarn is created by using a color concentrate containing 65% by weight polyethylene matrix and 35% Color Index pigment red 149 (Color Index Constitution 71137) containing a compound identified by Chemical Abstracts Registry Number [4948-15-6]. The gold yarn is created using a color concentrate containing 50% polyethylene matrix and 50% Color Index pigment brown 11. Pigment brown 11 has Color Index Constitution 77495 and is a mixture of 79% $Fe_2O_3$ and 10% MgO. A 70/24 bright, round cross section polyester tube is knitted. The PMP and polyester are scoured for ten minutes at 72° C. with the following additives:

20:1 bath ratio, deionized water 0.5 grams/liter Tanapon® X-70 (modified polyglycol ether surfactant commercially available from Sybron Chemicals, Inc.)

0.5 grams/liter soda ash (sodium carbonate)

For each of the three colors of poly(4-methyl-1-pentene), a swatch of fabric was cut. Then a polyester swatch weighing 20 times each poly(4-methyl-1-pentene) swatch was cut. Each of the pairs of poly(4-methyl-1-penetene) swatches and the corresponding polyethylene terephthalate swatches were dyed at 130° C. for one hour. Each color of poly(4-methyl-1-pentene) was examined using a fresh dyebath. The dye bath includes the following additives:

10:1 bath ratio, deionized water 1.5% o.w.f. Palegal® NB-SF (mixture of nonionic aliphatic compounds commercially available from BASF Corporation, Parsippany, N.J.)

2.0% o.w.f. Tinuvin® 326 paste (2-(2H-bezotriazol-2-yl)-6-(1,1-dimethylethyl)-4-methyl-phenol, Chemical Abstract Services Registry Number [3896-11-5], a uv stabilizer commercially available from Ciba-Geigy Corporation)

1.000% Terasil Yellow E2R (C.I. Disperse Yellow 86)

0.700% Terasil Brilliant Pink 3G (C.I. Disperse Red 302)

1.300% Terasil Blue E BLF (C.I. Disperse Blue 77)

1.000% Terasil Brilliant Blue BGE (C.I. Disperse Blue 60) (Terasil dyestuffs are commercially available from Ciba-Geigy Corporation.)

The bath pH is adjusted to 4.5 with acetic acid. Samples are rinsed sequentially in warm and cold water.

Samples are then after scoured at 72° C. as follows:

10:1 bath ratio, bath at 72° C.

0.5 grams/liter Tanapon ® INF (nonionic surfactant commercially available from Sybron Chemicals, Inc.)

1.5 grams/liter 50% sodium hydroxide

Samples are placed in the vessels and 1.5 grams/liter sodium hydrosulfite added and samples are scoured at 72° C. for 30 minutes. Samples are rinsed sequentially in warm and cold water, extracted and dried in a household tumble dryer. Delta E (total color change) values from the original undyed samples of PMP are below 25.0 units. Total color changes of the polyester samples from original color are no less than 60 units.

EXAMPLE 2

Three 100% polymethylpentene (PMP) yarns separately pigmented white, red and gold, are prepared as described in EXAMPLE 1. 70/24 bright, round cross section polyester knitted tubes are prepared. None of the samples are scoured. The polyester samples, 10 times the weight of each of the three colors of poly(4-methyl-1-pentene) yarn are dyed shades 1, 2 and 3 in the same dye bath as a sample of PMP at 130° C. for one hour and afterscoured as below:

10:1 bath ratio, deionized water 1.5 o.w.f. Palegal ® NB-SF 2.0% o.w.f. Tinuvin ® 326 paste Shade 1 4.0% Terasil Brilliant Blue BGE (C.I. Disperse Blue 60)

Shade 2 2.0% Terasil Yellow L-R (no C.I. number available)

Shade 3 2.0% Terasil Red L-B2 (no C.I. number available)

The bath pH is adjusted to 4.5 with acetic acid. Samples are rinsed sequentially with warm and cold water. Samples are then after scoured at 72° C. as follows:

10:1 bath ratio, bath at 72° C.

0.5 grams/liter Tanapon ® INF 1.5 grams/liter 50% sodium hydroxide

Samples are placed in vessels and 1.5 grams/liter sodium hydrosulfite added for scouring at 72° C. for 30 minutes. Samples are rinsed sequentially with warm and cold water and neutralized in a bath of approximately 40:1 with 0.25 grams/liter of 28% acetic acid. Samples are extracted and dried in a household tumble dryer. PMP samples dyed shade 1, 2 and 3 showed Delta E (total color change) values of below 21 units. Polyester samples dyed the same shades show total color changes of no less than 60 units relative to their originals.

EXAMPLE 3

A red poly(4-methyl-1-pentene) yarn is produced as described in Example 1. An uncolored polyethylene terephthalate yarn is prepared by conventional methods. The PMP and polyester yarns are of similar cross-sectional volume. The denier is different since there is a very significant density difference between polyethylene terephthalate and poly(4-methyl-1-pentene). The two yarns are placed in a warping creel so that the warp beam has 32 polyethylene terephthalate yarns and 4 red poly(4-methyl-1-pentene) yarns. These warp beams are placed on a 32 gauge warp knitting machine. The fabric is knitted. The fabric has one eighth inch wide red stripes separated by 1 inch wide uncolored polyethylene terephthalate stripes in the machine direction of the cloth. This cloth is scoured, dyed and scoured a second time using the procedures and chemicals described in EXAMPLE 1, with the quantities proportionally larger to match the larger weight of fabric being processed. The resulting cloth is predominantly blue with red stripes. Although the red stripes absorbed a small amount of the blue from the dyebath, they remain red in appearance, giving a contrasting stripe.

What is claimed is:

1. A predominantly polyester fabric having a multi-colored pattern, comprising:

at least one non-aromatic polymethylolefin yarn melting above about 180° C. as less than 50%, by weight, of said fabric; wherein said polymethylolefin is selected from: poly(4-methyl-1-pentene); poly(3-methyl-1-butene); and poly(4-methyl-1-hexene) and polyester yarn, said polymethylolefin yarn and said polyester yarn woven or knitted into a predetermined pattern and then piece dyed with disperse dye techniques.

2. The fabric of claim 1, wherein said polymethylolefin is poly(4-methyl-1-pentene).

3. The fabric of claim 2, wherein one color pre-colored polymethylpentene yarn is used.

4. The fabric of claim 2, wherein two or more different colored precolored polymethylpentene yarns are used.

5. The fabric of claim 2, wherein uncolored polymethylpentene yarn is used.

6. The fabric of claim 2, wherein said fabric is a warp knit fabric and polymethylpentene pre-colored or uncolored yarn is used as a portion of warp yarns.

7. The fabric of claim 2, where said polyester fiber is polyethylene terephthalate.

8. The fabric of claim 2, where said polyester yarn is polybutylene terephthalate.

9. A method of producing a dyed polyester fabric having a multi-colored pattern comprising the steps of:

(a) providing at least one non-aromatic, partially crystalline polymethylolefin yarn melting above about 180° C. in a predetermined pattern as a portion of warp yarns wherein the polymethyl olefin is selected from: poly(4-methyl-1-pentene); poly(3-methyl-1-pentene); poly(3-methyl-1-hexene);

(b) providing a polyester yarn in a predetermined pattern as warp yarn;

(c) warp knitting a fabric from the yarn of (a) and the yarn of (b), thereby producing a polyester warp knit fabric; and (d) dyeing the fabric of (c) with disperse dyes and disperse dyeing techniques to produce a multi-colored, patterned fabric.

10. The method of claim 9, wherein the fabric is used as an automotive upholstery fabric.

11. The method of claim 9, wherein the polymethylolefin is poly(4-methyl-1-pentene).

12. The method of claim 11, wherein said polyester is polyethylene terephthalate.

13. The method of claim 11, wherein said polyester is polybutylene terephthalate.

* * * * *

UNITED STATES PATENT AND TRADEMARK OFFICE

CERTIFICATE OF CORRECTION

PATENT NO. : 5,169,405
DATED : December 8, 1992
INVENTOR(S) : Matthew B. Hoyt, et. al.

It is certified that error appears in the above-indentified patent and that said Letters Patent is hereby corrected as shown below:

Column 6, line 23, insert --in said fabric-- after "pattern" and before "and"

Signed and Sealed this

Nineteenth Day of October, 1993

*Attest:*

*Attesting Officer*

BRUCE LEHMAN

*Commissioner of Patents and Trademarks*